US006371189B1

(12) United States Patent
Azoulai

(10) Patent No.: US 6,371,189 B1
(45) Date of Patent: Apr. 16, 2002

(54) ROLLER SHUTTER

(75) Inventor: Haim Azoulai, Tel Aviv (IL)

(73) Assignee: Kol Chen Ltd., Holon (IL)

( * ) Notice: Subject to any disclaimer, the term of this patent is extended or adjusted under 35 U.S.C. 154(b) by 0 days.

(21) Appl. No.: 09/704,773

(22) Filed: Nov. 3, 2000

(30) Foreign Application Priority Data

Jul. 21, 2000 (IL) ..... 137432

(51) Int. Cl.[7] ..... E06B 9/08

(52) U.S. Cl. ..... 160/133; 160/113; 160/220

(58) Field of Search ..... 160/133, 166.1 R, 160/168.1 R, 172 R, 174 R, 176.1 R, 178.1 R, 113, 220, 201, DIG. 15

(56) References Cited

U.S. PATENT DOCUMENTS

| | | | | | |
|---|---|---|---|---|---|
| 96,014 | A | * | 10/1869 | Knevitt et al. | 160/133 |
| 514,605 | A | | 2/1894 | Rasmusson et al. | |
| 1,130,465 | A | * | 3/1915 | Bauer | 160/133 |
| 1,638,344 | A | | 8/1927 | Kocher | |
| 1,786,505 | A | | 12/1930 | Phillips | |
| 1,893,182 | A | | 1/1933 | Seregi | |
| 1,912,817 | A | | 6/1933 | Bauer | |
| 1,966,728 | A | | 7/1934 | Lecluyse | |
| 2,047,453 | A | | 7/1936 | Allen | |
| 2,579,485 | A | | 12/1951 | Ferguson et al. | |
| 2,921,628 | A | * | 1/1960 | Alvarez | 160/133 |
| 3,034,574 | A | | 5/1962 | Gerold | |
| 3,302,692 | A | * | 2/1967 | Grau | 160/133 |
| 3,324,929 | A | * | 6/1967 | Griesser | 160/133 |
| 3,429,355 | A | * | 2/1969 | Griesser | 160/133 |
| 4,010,790 | A | | 3/1977 | Varga | |
| 4,013,113 | A | * | 3/1977 | Frei | 160/133 X |
| 4,356,668 | A | | 11/1982 | Wagner | |
| 4,662,420 | A | * | 5/1987 | Hirao | 160/133 X |
| 5,183,093 | A | * | 2/1993 | Kraeutler | 160/133 X |
| 5,435,371 | A | * | 7/1995 | Cheng | 160/133 |
| 5,476,130 | A | | 12/1995 | Cheng | |
| 5,682,937 | A | * | 11/1997 | Decrane et al. | 160/133 |
| 6,076,587 | A | | 6/2000 | Pastor | |

* cited by examiner

*Primary Examiner*—Bruce A. Lev

(57) ABSTRACT

A roller shutter for a window or doorway wall opening, comprising a plurality of elongate slats coupled together to form a slat assembly, and a winding device overlying the slat assembly for winding and unwinding the slat assembly to a fully-closed position, a fully-opened position, and a partially-opened position with respect to the wall opening. The slats are coupled together by flexible coupling links coupled between adjacent slats at both ends of the slats, which permit each slat, when in a fully-opened or partially-opened position with respect to the wall opening, to move linearly away from an adjacent slat in the slat assembly to create a light and air space between the adjacent slats and linearly towards the adjacent slat in the slat assembly to close or restrict the light and air spaces, and angularly with respect to the adjacent slat in the slat assembly to enable the slat assembly to be wound onto or unwound from the winding device.

17 Claims, 10 Drawing Sheets

Fig.4
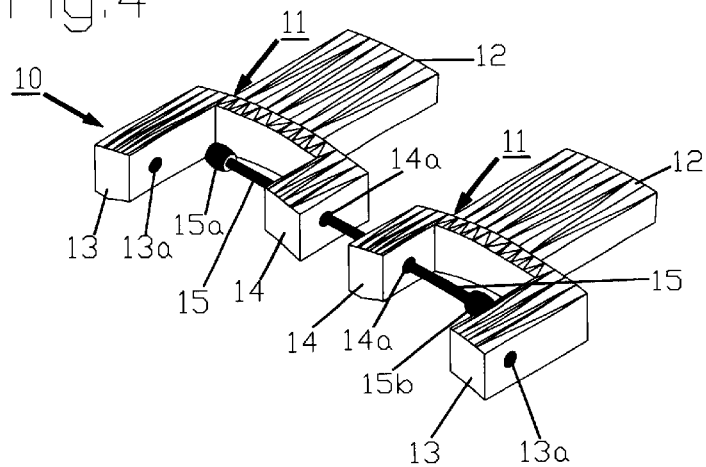
Fig.5
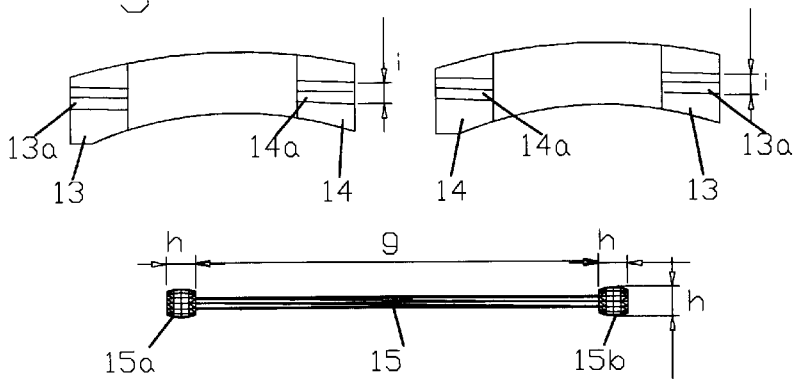
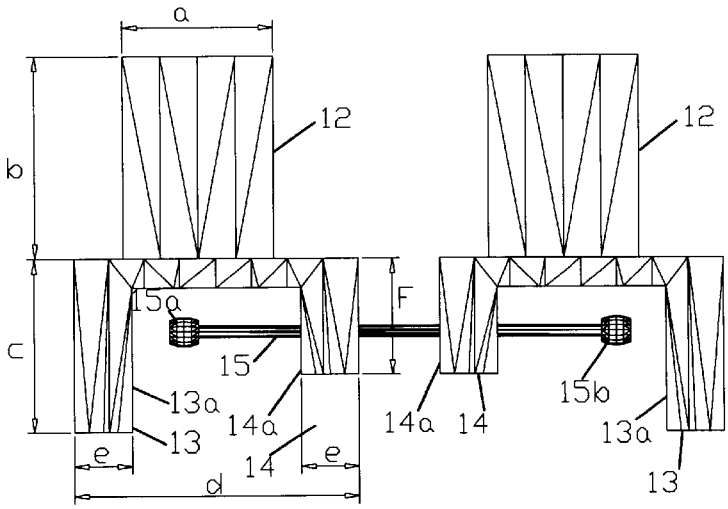
Fig.6

ROLLER SHUTTER

FIELD AND BACKGROUND OF THE INVENTION

The present invention relates to roller shutters, such as applied to window or doorway wall openings, to control the passage of air and light, as well as persons and objects, through the wall opening.

More particularly, the invention relates to roller shutters of the type which include a plurality of elongate slats coupled together to form a slat assembly, and a winding device, e.g., a rotatable drum, overlying the slat assembly for winding and unwinding the slat assembly to a fully-closed position, a fully-open position, and a partially-open position, with respect to the wall opening. In such roller shutters, it is desirable to couple the slats together by couplings which permit the slats, when the slat assembly is in a fully-opened or partially-opened position with respect to the wall opening, to move; a) linearly away from its adjacent slats in the slat assembly to create light and air spaces between adjacent slats; b) linearly towards its adjacent slats in the slat assembly to close or restrict the light and air spaces, and c) angularly with respect to its adjacent slats in the slat assembly to enable the slat assembly to be wound onto or unwound from the winding device.

Many different roller shutter constructions have been proposed and described in the patent literature to enable the slat assembly to serve the foregoing functions. Most of the prior designs include various constructions of elongate linking slats, or elongate linking extensions to the shutter slats in the slat assembly, which linking slats or extensions extend for the length of, and between, the shutter slats and are formed with openings to be opened or closed by the linear movements of the shutter slats with respect to each other. However, such construction, including linking slats or linking extensions to the shutter slats, limit the sizes of the light and air spaces which can be opened by the linear movements of the slats. Moreover, such linking slats and linking extensions may jam or otherwise interfere with the winding and unwinding of the slat assembly. Further, they require a significant amounts of additional slat material, thereby increasing the cost of producing such slats as well as the weight of the completed shutter.

Another construction recently appearing on the market utilizes pivotal joints pivotally and slidably coupling the slats with each other to permit each slat to move linearly by a slideable action, and angularly by a pivotal action, with respect to its adjacent slats. However, such pivotal joints constrain the relative movements of the slats to pivotal and slideable movements. Such pivotal and slidable movements of solid surfaces with respect to each other increase the possibility of jamming during an operation of the shutter, increase friction between the relatively moveable parts and therefore wear and tear, and also require low-friction materials to minimize the friction and wear and tear. Such shutters are also relatively expensive to produce and assemble, and to disassemble for repair or replacement of slats.

OBJECT AND BRIEF SUMMARY OF THE PRESENT INVENTION

An object of the present invention is to provide a rotatable shutter having advantages in one or more of the above respects.

The present invention relates to a roller shutter for a window or doorway wall opening, comprising: a plurality of elongate slats coupled together to form a slat assembly; and a winding device overlying the slat assembly for winding or unwinding the slat assembly to a fully-closed position, a fully-opened position, and a partially-opened position, with respect to the wall opening; the slats being coupled together by couplings which permit each slat, when in a fully-opened or partially-opened position with respect to the wall opening, to move: (a) linearly away from an adjacent slat in the slat assembly to create a light and air space between the adjacent slats; (b) linearly towards the adjacent slat in the slat assembly to close or restrict the light and air spaces; and (c) angularly with respect to the adjacent slat in the slat assembly to enable the slat assembly to be wound onto or unwound from the winding device.

The present invention is characterized in that the couplings are flexible links coupling each side of each slat to the respective side of the adjacent slat.

According to the preferred embodiment of the invention described below, the flexible links may be in the form of short lengths of flexible wires or fibers, or flexible plastic strips, coupled at their ends to the sides of adjacent slats.

According to further features, each of the attachments comprise: a base attached to the side of the slat; and a pair of arms integrally formed with the base such that the arms project laterally from the respective side of the slat with one arm overlying the other. Each of the flexible links couples the overlying arm of one slat with the underlying arm of the adjacent overlying slat. In the described preferred embodiment, each of the arms is formed with a hole for receiving the respective flexible link, and each of the flexible links is formed with an enlarged head at each end blocking the pull-out of the flexible link from its respective hole during a normal use of the shutter.

As will be described more particularly below, roller shutters constructed in accordance with the foregoing features permit substantial amounts of light and air spaces to be created between adjacent slats, as compared to the prior art constructions briefly described above including elongate linking slats or linking extensions to the shutter slats. Since the couplings do not involve pivotal or slidable joints, but rather flexible links, they avoid the above-mentioned dangers of jamming, high friction, and high wear and tear involved in the roller shutter including pivotal-slidable joints; and moreover, they are less expensive to produce, assemble and disassemble for repair or slat-replacement purposes.

Further features and advantages of the invention will be apparent from the description below.

BRIEF DESCRIPTION OF THE DRAWINGS

The invention is herein described, by way of example only, with reference to the accompanying drawings, wherein:

FIG. 4 more particularly illustrates the manner of applying a flexible link to the sides of adjacent slats;

FIG. 5 is a view of the main parts of the flexible coupling of FIG. 4;

FIG. 6 is a top plan view of the flexible coupling of FIG. 4;

DESCRIPTION OF A PREFERRED EMBODIMENT

Figure 1:
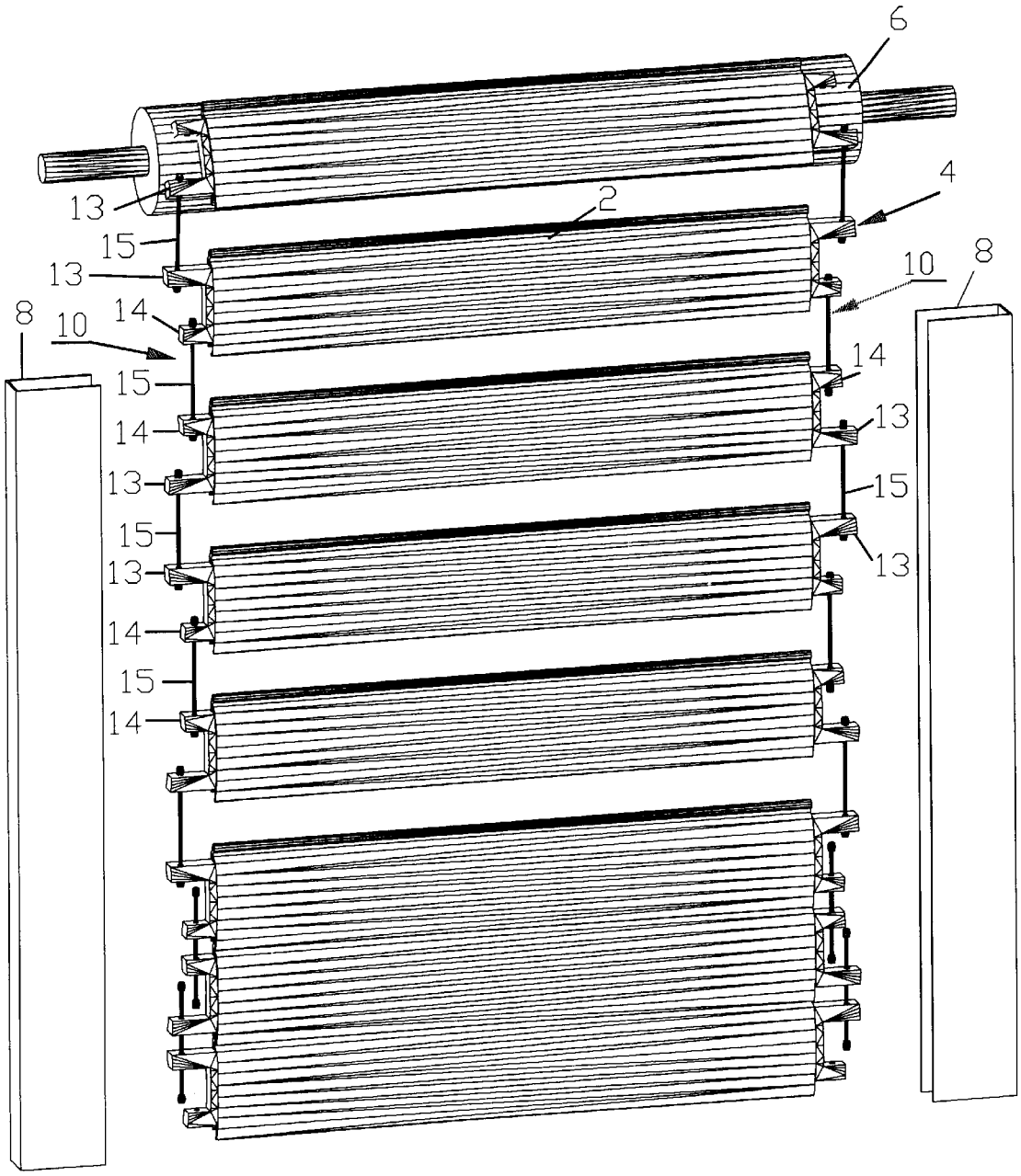
FIG. 1 is a partially exploded view illustrating one form of roller shutter constructed in accordance with the present invention.
Figure 8A:
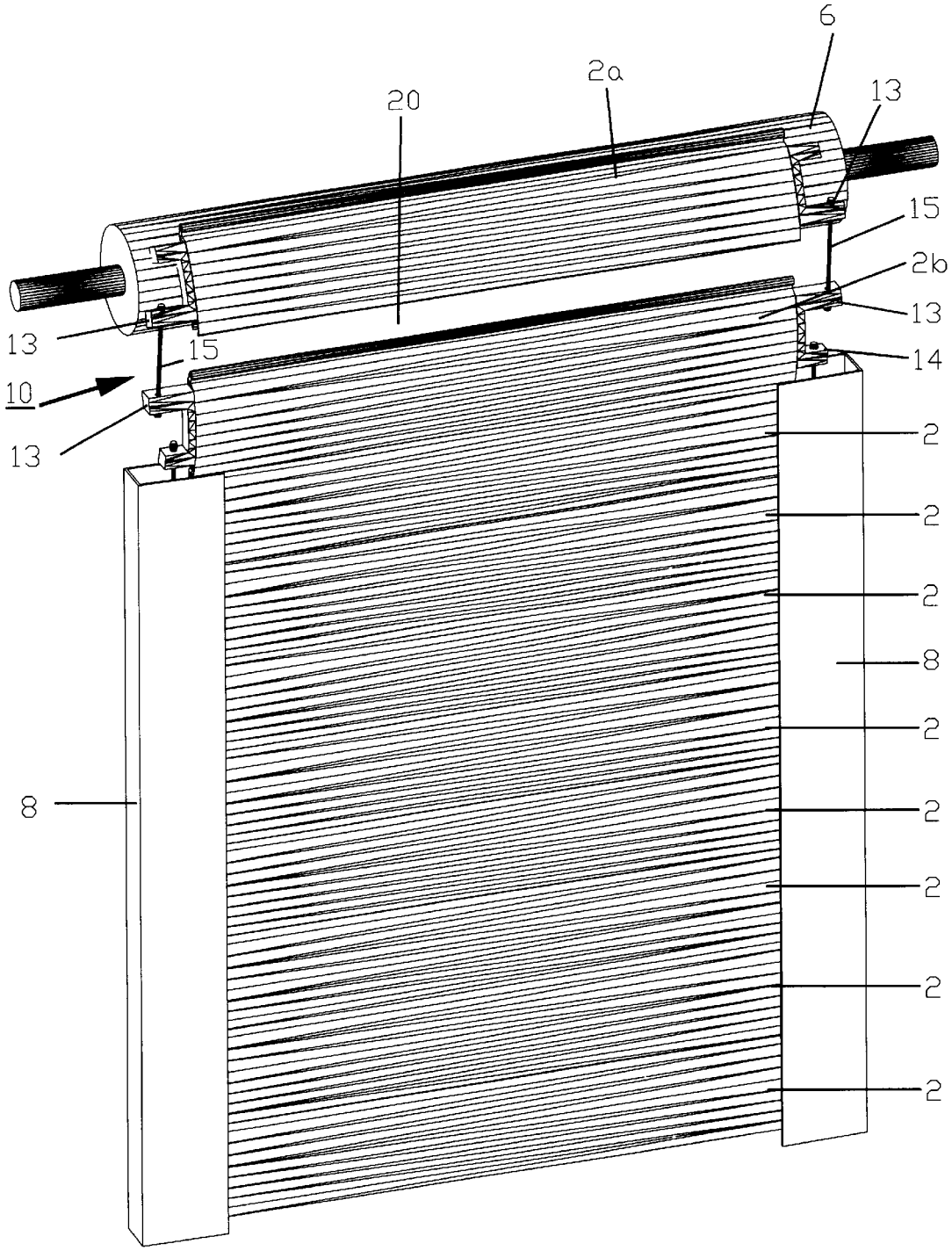
FIG. 8*a*–8*d* illustrate various conditions of a roller shutter constructed as illustrated in FIG. 1.

FIG. 1 illustrates a roller shutter to be applied to a wall opening, such as one serving as a window or doorway, for controlling the passage of air and light, as well as the movement of objects and persons, through the wall opening. The shutter includes a plurality of elongate slats 2 coupled together to form a slat assembly, generally designated 4, and a rotatable drum 6 overlying the slat assembly 4 for winding or unwinding it to a fully-closed position (as shown in FIG. 8*a*), to a fully-open position (not shown), or to a partially-open position (shown in FIG. 8*d*). The illustrated shutter further includes a pair of channel members 8 located on the opposite sides of the slat assembly 4. Channel member 8 cover the opposite sides of the slats 2 in the assembly 4, as well as their couplings, enabling the slat assembly to be moved to the fully-closed, fully-opened, or partially-opened positions.

The couplings between the slats 2 to provide the foregoing functions are effected by coupling devices, generally designated 10 applied to both sides of the slat assembly 4. As will be more particularly described below, the coupling devices 10 include flexible links which permit each slat 2, when the slat assembly 4 is in a fully-opened or partially-opened position, to move as follows: (a) linearly away from its adjacent slat to create a light and air space between the adjacent slats; (b) linearly towards its adjacent slat to close or restrict the light and air space, and (c) angularly with respect to its adjacent slat to enable the slat assembly to be wound onto or unwound from the rotatable drum 6.

Figure 2:
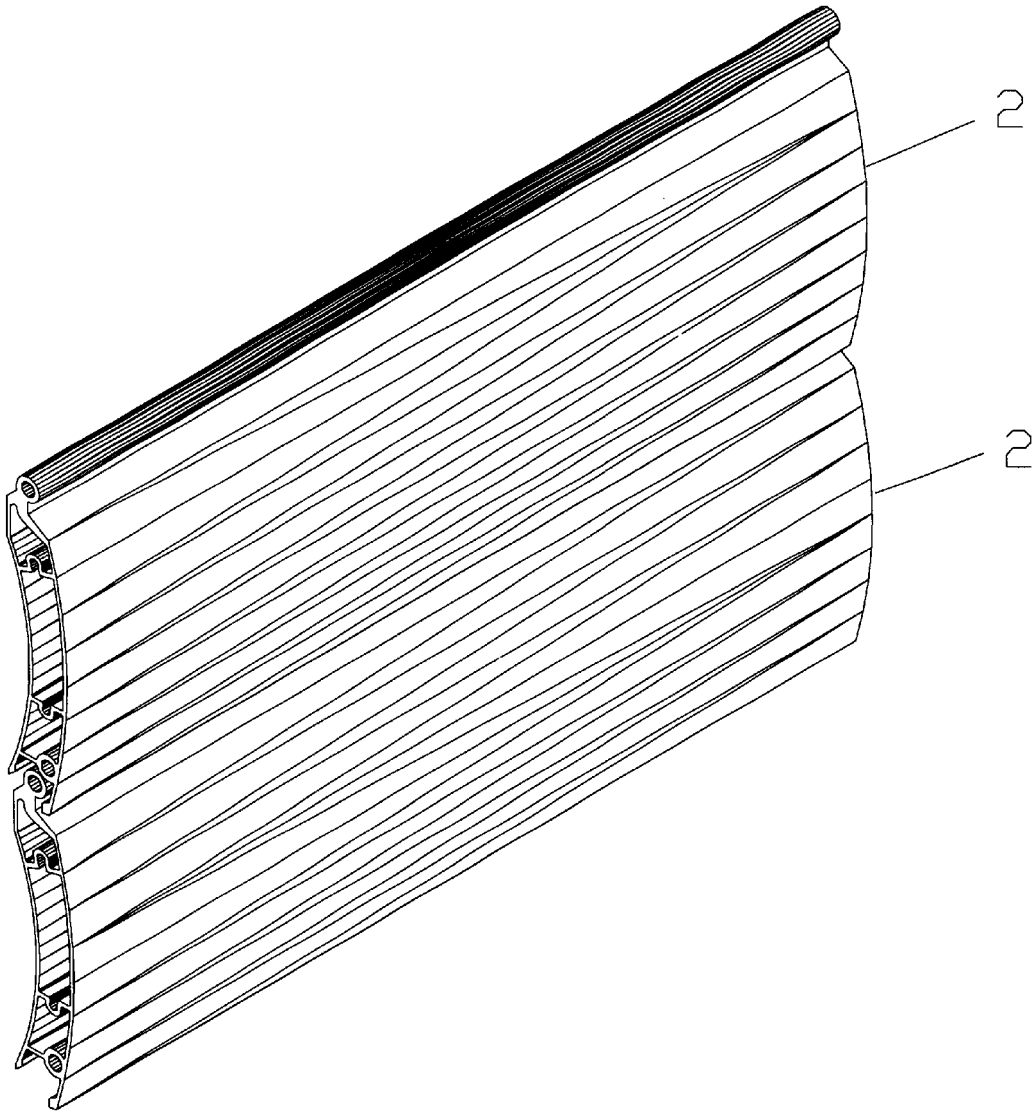
FIG. 2 is an enlarged perspective view illustrating the construction of each of the elongate slats in the roller shutter of FIG. 1.

FIG. 2 illustrates the construction of a conventional slat 2, wherein it will be seen that it is of a hollow construction generally made by extrusion of plastic.

Figure 3:
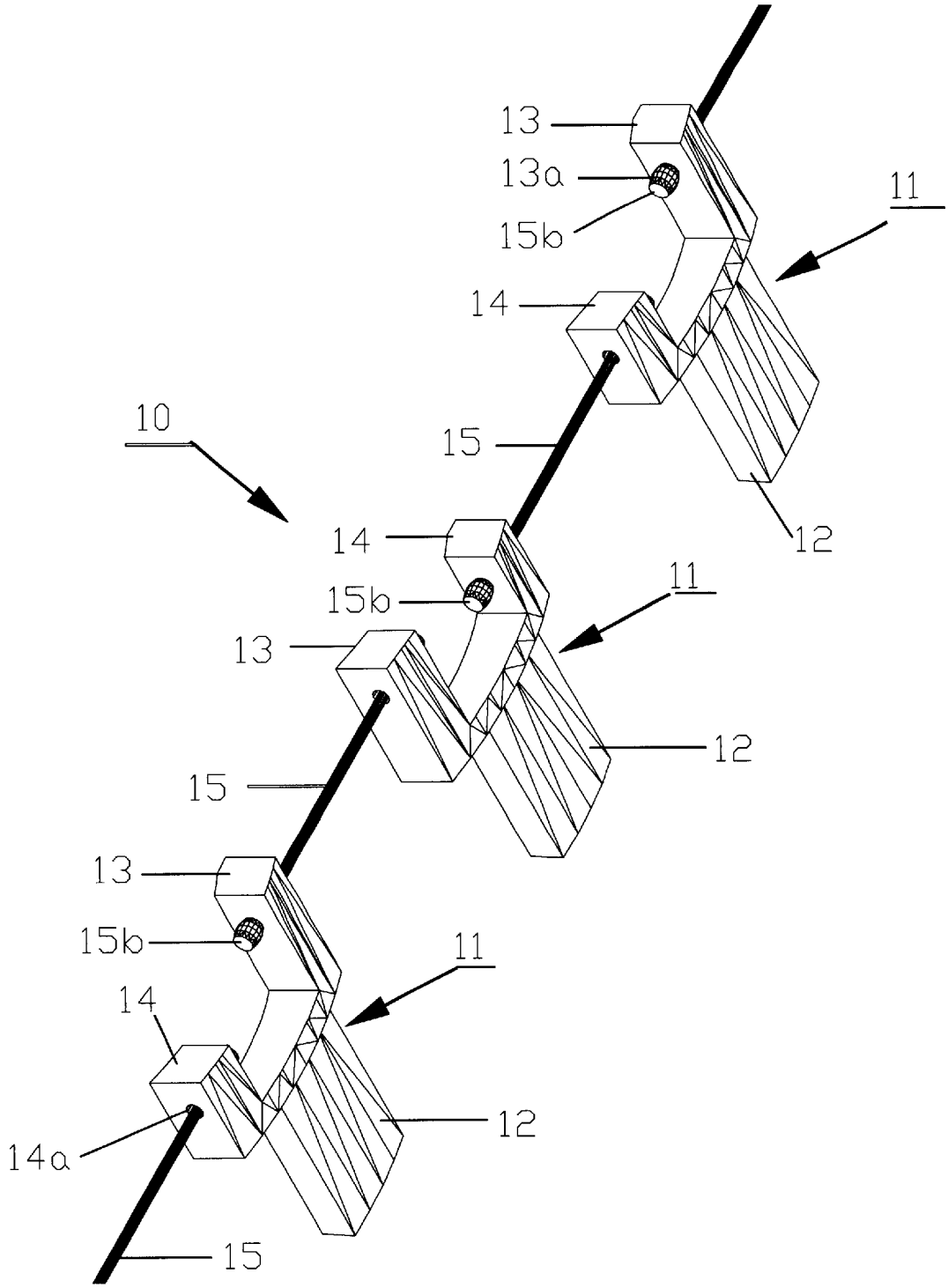
FIG. 3 is an enlarged perspective view more particularly illustrating the flexible links coupling the sides of adjacent slats in the roller shutter of FIG. 1.

The construction of each of the coupling devices 10 is more particularly illustrated in FIG. 3. Each coupling device 10 includes an attachment, generally designated 11, preferably of plastic material and integrally formed with a base 12 and two parallel arms 13, 14. The base 12 is constructed to be inserted, by a force fit, into the hollow side of the respective slat 2, such that the two arms 13, 14 project laterally from the respective side of the slot with one arm overlying the other, as shown for example in FIG. 1. As also shown in FIG. 1, and particularly in FIG. 3, one arm 13 is longer than the other arm 14. In addition, each of the arms is formed with an opening 13*a*, 14*a*, respectively, adjacent to the other end of the arm, so that the openings are not in alignment with each other.

As indicated above, each coupling device 10 further includes a flexible link 15 linking two adjacent arms of two slats. Thus, each of the flexible links 15 may be in the form of a short length of a flexible wire, cable, fibers, or the like, of metal, plastic, fabric, or other suitable material, or may be short flexible plastic strips. The diameter of each flexible link 15 is such that it freely passes through the aligned openings 13*a*, 14*a*, in the adjacent arms 13, 14 of the respective attachments 11. Each flexible link 15 is further formed with an enlarged head 15*a*, 15*b* at its opposite ends to block the pull-out of the flexible link from its respective hole in the normal use of the shutter.

As shown particularly in FIG. 1, the attachments 11 are applied to the slats 2 such that a pair of long arms 13 face each other in one pair of adjacent slats, and a pair of short arms 14 face each other in the next pair of adjacent slats. Thus, the positions of the flexible links 15 received within the openings in these arms would be in a staggered relationship, as also seen in FIG. 1.

The enlarged heads 15*a*, 15*b* are provided at the opposite ends of each of the flexible links 15 to block pull-out from the respective holes. Such heads may be integrally formed at the opposite ends of the flexible links 15, in which case they would have to be force-fitted through their respective holes. Preferably, however, the enlarged heads are in the form of caps removably attachable to the opposite ends of the flexible link 15, to permit the caps to be applied to their opposite ends after the links have been inserted through the holes 13*a*, 14*a* in the arms 13, 14 of the attachments 11.

FIGS. 5 and 6 more particularly illustrate a preferred construction of the attachments 11 and their respective flexible links 15. Such a construction may have the following dimensions: (in mms): a=26.0, b=35.0, c=30.0, d=49.3, e=10.0, f=20.0, g=70.0, h=5.0, and i=3.5.

Figure 7A:
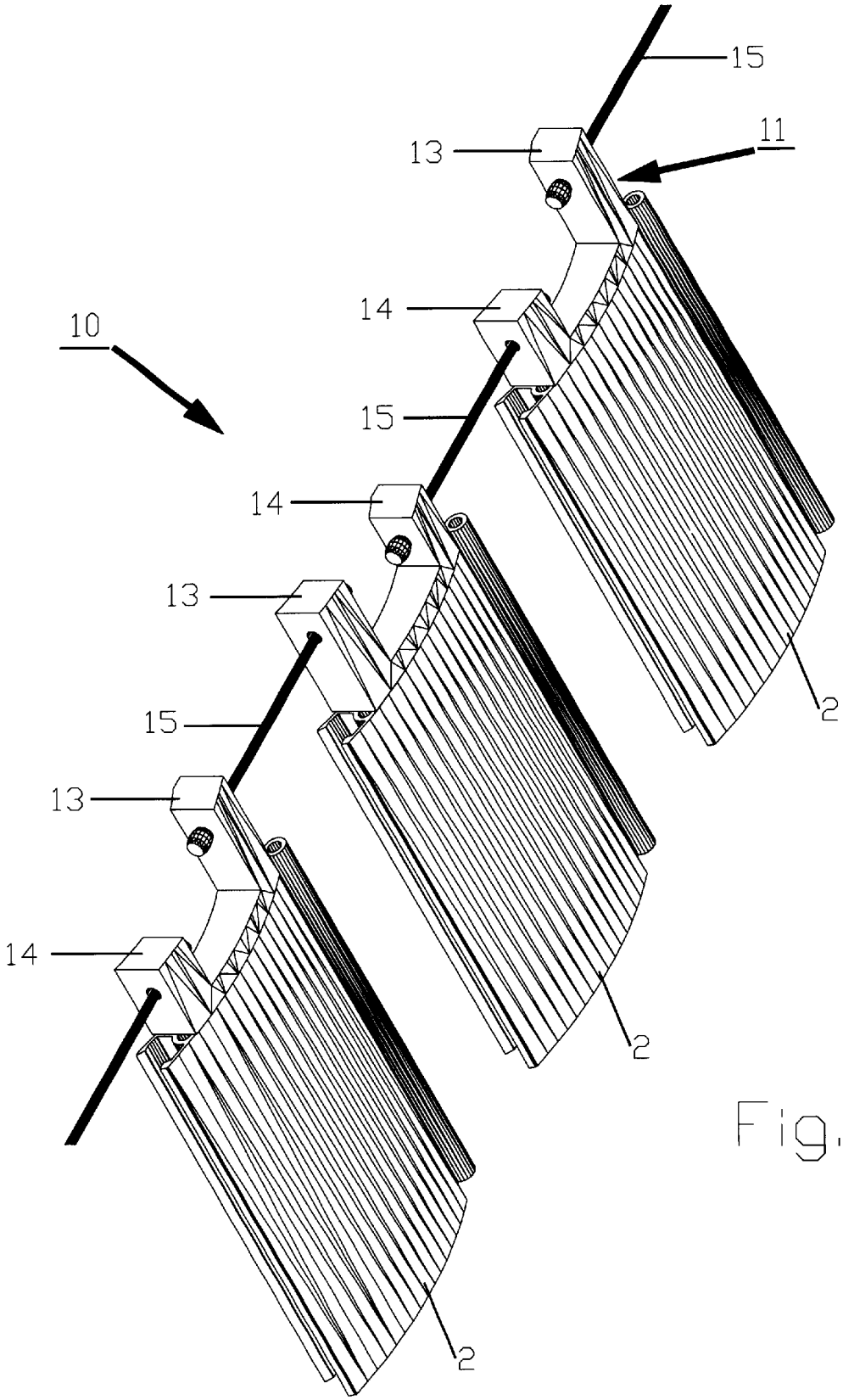
FIG. 7*a* illustrates a plurality of slats in the maximum spaced-apart position permitted by the flexible links coupling the sides of adjacent slats to allow the maximum light and air to pass between the slats.
Figure 7B:
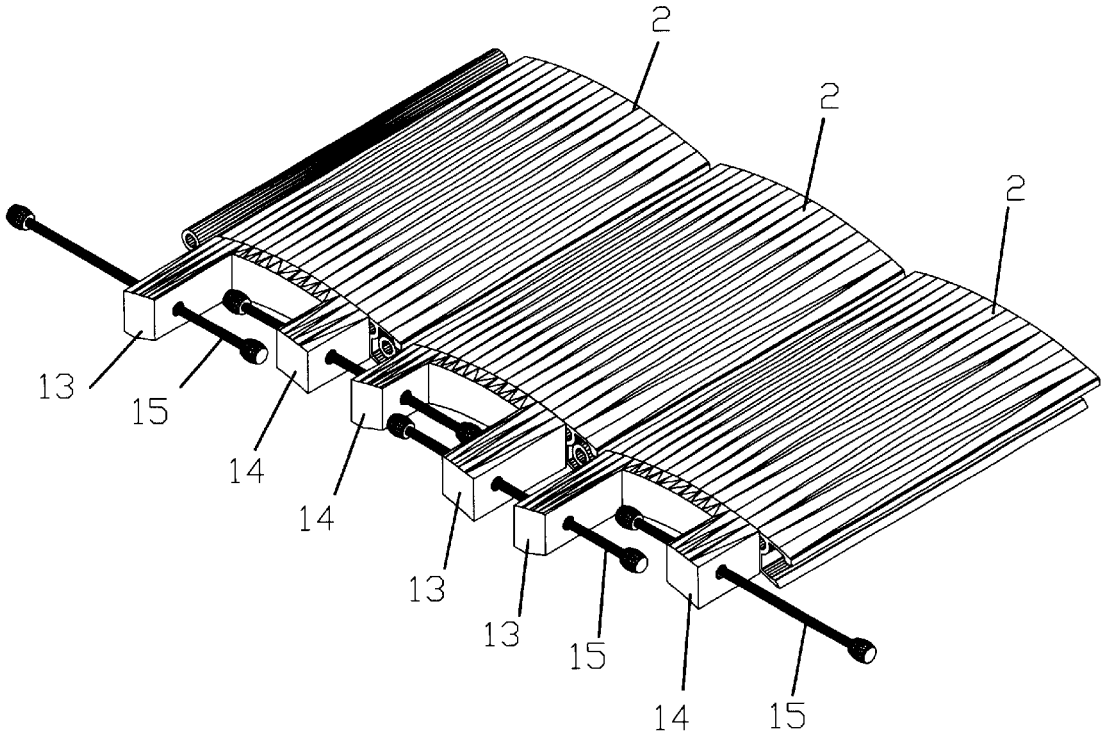
FIG. 7*b* is a perspective view illustrating the closed position of the slats of FIG. 7*a*.

It will be seen that the flexible links 15 support the slats 2 by suspension in a manner which enables each slat to move as follows: a) linearly away from its adjacent slats in the slat assembly to create light and air spaces between adjacent slats (FIG. 7*a*); b) linearly towards its adjacent slats in the slat assembly to close or restrict the light and air spaces (FIG. 7*b*); and c) angularly with respect to its adjacent slats in the slat assembly to enable the slat assembly to be wound onto or unwound from the rotatable drum 6.

Figure 8B:
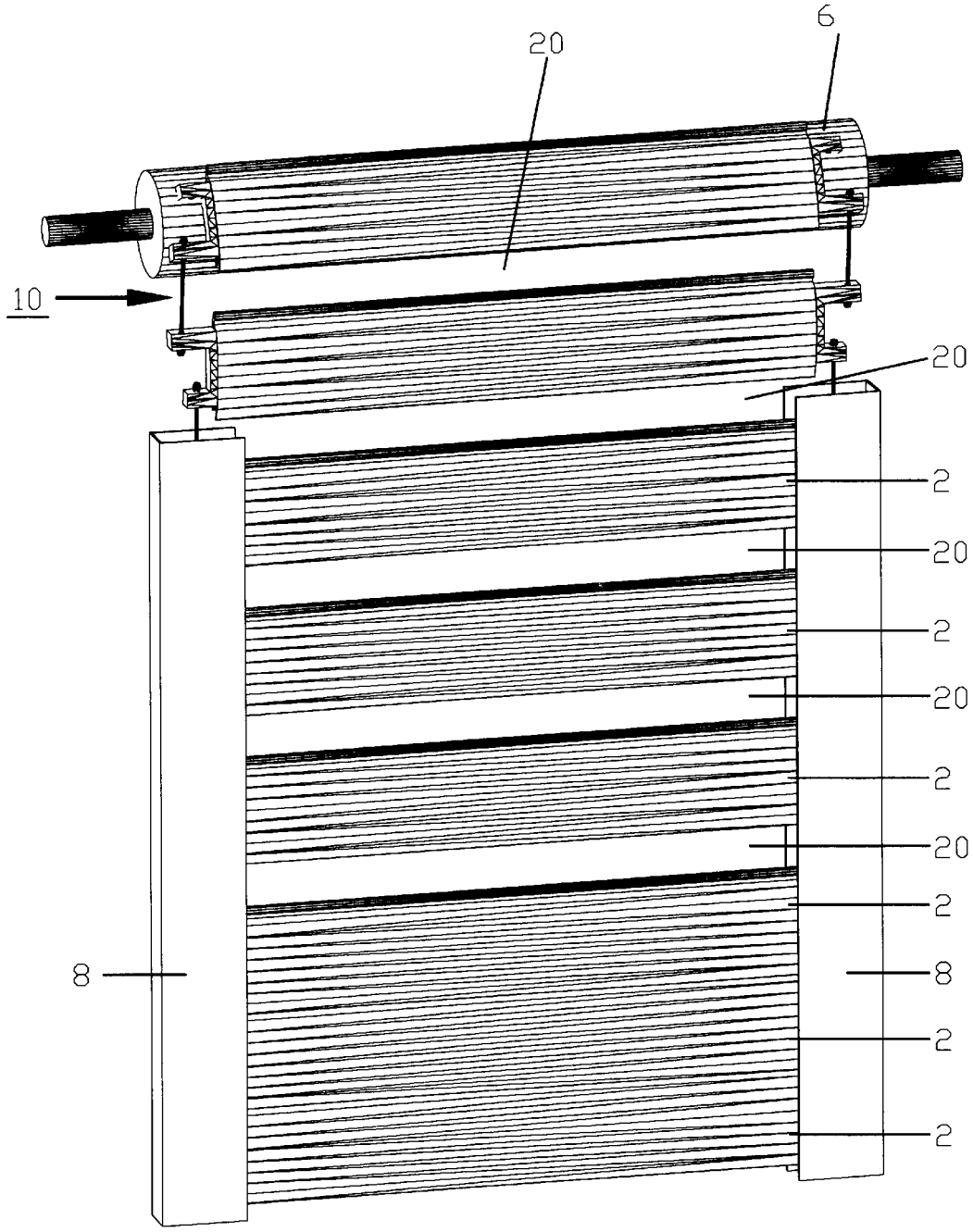
Figure 8C:
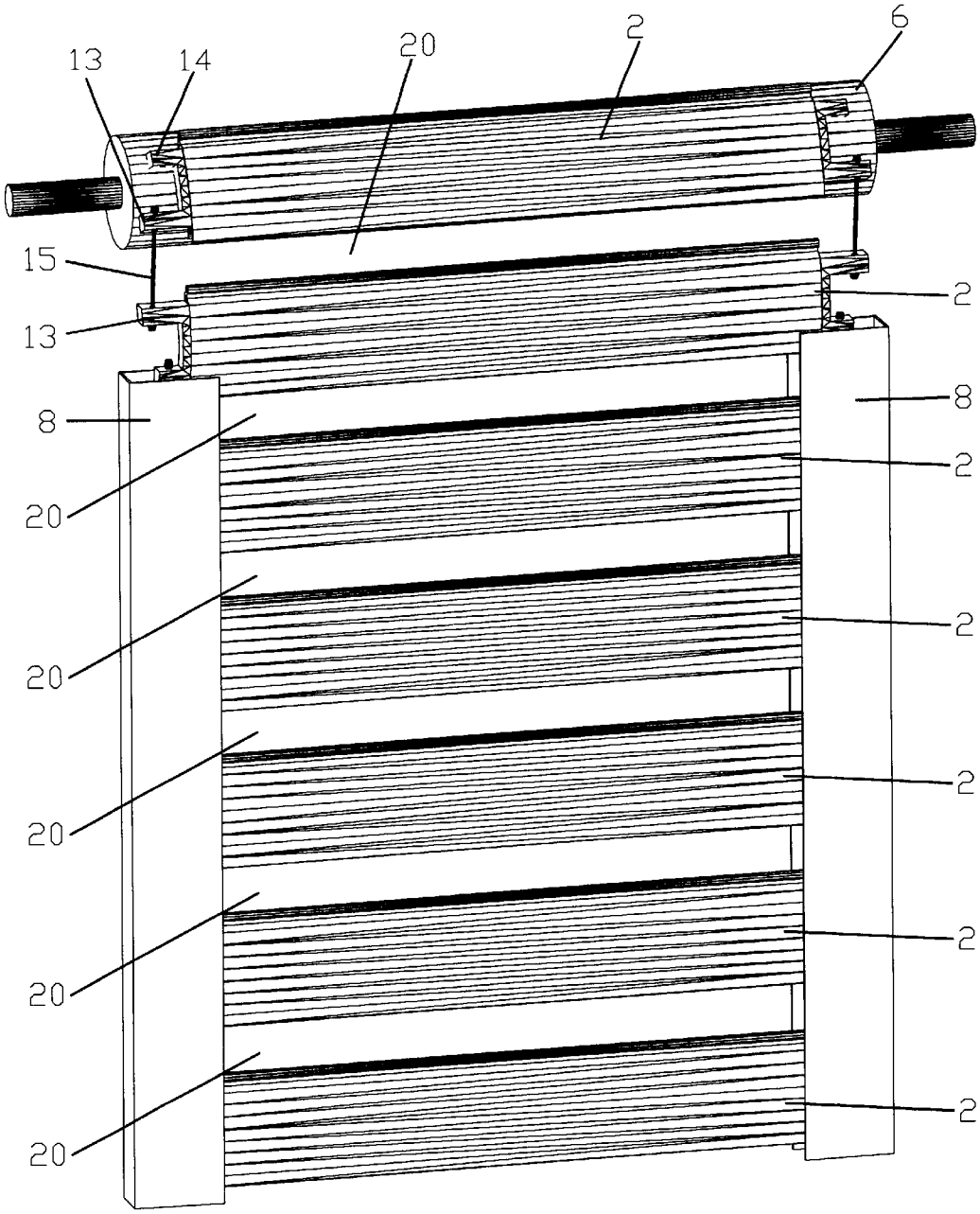
Figure 8D:
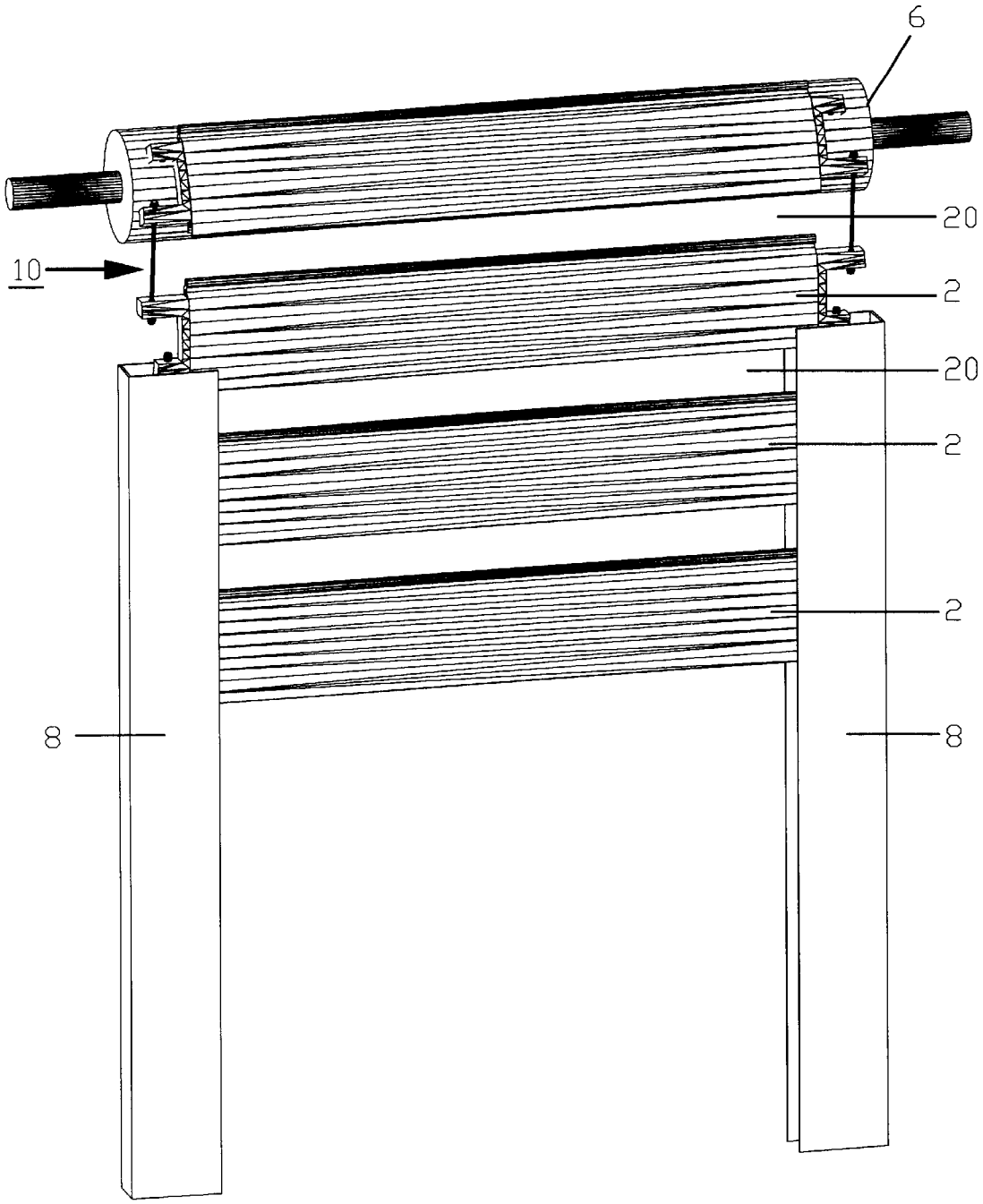

FIGS. 8*a*–8*d* illustrate various conditions of the roller shutter of FIG. 1. Thus, FIG. 8*a* illustrates the condition wherein the shutter assembly is in its fully-closed position, and each of the slats 2 has been moved linearly towards its adjacent slats to completely close or restrict the light and air spaces, except for the topmost slat 2*a* which has just been started to be wound onto the drum 6 so as to create the space 20 between it and the next underlying slat 2*b*. FIG. 8*b* illustrates the condition wherein a number of slats have been wound onto the drum 6 so that air and light spaces 20 have been created between the upper slats 2, but the lower slats are still fully closed. FIG. 8*c* illustrates the condition wherein a number of further slats have been wound onto the drum 6, thereby creating light and air spaces 20 between each slat 2 and its adjacent slats. FIG. 8*d* illustrates the condition wherein the slat assembly has been further wound onto the drum 6 so that the lowermost slat 2 has been raised to partially open the wall opening, whereas the slats still located within the wall opening having been moved apart so as to create air and light spaces between them.

It will be appreciated that further rotation of the drum 6 to wind up the remaining slats within the wall opening will completely open the wall opening.

While the invention has been described with respect to one preferred embodiment, it will be appreciated that this is set forth merely for purposes of example, and that many variations may be made. For example, other forms of flexible links could be used. In addition, the invention could be embodied in roller shutters permitting independent tilting of the slats 2 to partially or completely open them. Many other variations, modifications and applications of the invention will be apparent.

What is claimed is:

1. A roller shutter for a window or doorway wall opening, comprising:

a plurality of elongate slats coupled together to form a slat assembly;

and a winding device overlying the slat assembly for winding and unwinding the slat assembly to a fully-closed position, a fully-opened position, and a partially-opened position, with respect to said wall opening;

said slats being coupled together by couplings which permit each slat, when in a fully-opened or partially-opened position with respect to said wall opening, to move:

a) linearly away from an adjacent slat in the slat assembly to create a light and air space between the adjacent slats;

b) linearly towards said adjacent slat in the slat assembly to close or restrict said light and air spaces; and c) angularly with respect to said adjacent slat in the slat assembly to enable the slat assembly to be wound onto or unwound from said winding device;

characterized in that said couplings are flexible links coupling each side of each slat to the respective side of the adjacent slat;

said flexible links being coupled to attachments attached to the sides of the slats;

each of said attachments comprising a base attached to the side of the slat; and a pair of arms integrally formed with said base such that the arms project laterally from the respective side of the slat with one arm overlying the other;

each of said flexible links coupling the overlying arm of each slat with the underlying arm of the adjacent overlying slat.

2. The shutter according to claim 1, wherein said flexible links are in the form of short lengths of flexible wires or fibers coupled at their ends to the sides of the adjacent slats.

3. The shutter according to claim 1, wherein said flexible links are in the form of short lengths of flexible plastic strips coupled at their ends to the sides of the adjacent slats.

4. The shutter according to claim 1, wherein one of said arms of the attachment is longer than the other of said arms of the attachment, each of said flexible links coupling together arms of equal lengths in the attachments of two adjacent slats.

5. The shutter according to claim 1, wherein each of said arms is formed with a hole for receiving the respective flexible link, each of said flexible links being received in the holes of two arms attached to adjacent slats and being formed with an enlarged head at each end preventing the pull-out of the flexible link from its respective hole during a normal use of the shutter.

6. The shutter according to claim 5, wherein said enlarged heads are in the form of caps removably attachable to the opposite ends of the flexible links.

7. The shutter according to claim 5, wherein said enlarged heads are integrally formed at the opposite ends of the flexible links.

8. The shutter according to claim 1, wherein said slats are hollow, and each of said attachments is attached to the respective side of a slat by the insertion of the base of the attachment into the hollow side of the slat.

9. The shutter according to claim 1, wherein said winding device is a rotatable drum.

10. The shutter according to claim 1, wherein the shutter further includes a pair of channel members below said winding device and enclosing the sides of the slats and said flexible links coupling the sides of adjacent slats.

11. A roller shutter for a window or doorway wall opening, comprising:

a plurality of elongate slats coupled together to form a slat assembly;

a rotatable drum overlying the slat assembly for winding and unwinding the slat assembly to a fully-closed position, a fully-opened position, and a partially-opened position, with respect to said wall opening;

and a pair of channel members below said rotatable drum and enclosing sides of the slats;

said slats being coupled together by couplings which permit each slat, when in a fully-opened or partially-opened position with respect to said wall opening, to move:

a) linearly away from an adjacent slat in the slat assembly to create a light and air space between the adjacent slats;

b) linearly towards said adjacent slat in the slat assembly to close or restrict said light and air space, and c) angularly with respect to said adjacent slat in the slat assembly to enable the slat assembly to be wound onto or unwound from said winding device;

characterized in that said couplings are flexible links coupling each side of each slat to the respective side of the adjacent slat and also enclosed within said channel members;

said flexible links being coupled to attachments attached to the sides of the slats;

each of said attachments comprising a base attached to the side of the slat; and a pair of arms integrally formed with said base such that the arms project laterally from the respective side of the slat with one arm overlying the other;

each of said flexible links coupling the overlying arm of each slat with the underlying arm of the adjacent overlying slat.

12. The shutter according to claim 11, herein said flexible links are in the form of short lengths of flexible wires or fibers coupled at their ends to the sides of the adjacent slats.

13. The shutter according to claim 11, wherein said flexible links are in the form of short lengths of flexible plastic strips coupled at their ends to the sides of the adjacent slats.

14. The shutter according to claim 11, wherein one of said arms of the attachment is longer than the other of said arms of the attachment, each of said flexible links coupling together arms of equal lengths in the attachments of two adjacent slats.

15. The shutter according to claim 11, wherein each of said arms is formed with a hole for receiving the respective flexible link, each of said flexible links being received in the holes of two arms in the attachments of adjacent slats and being formed with an enlarged head at each end preventing the pull-out of the flexible link from its respective hole during a normal use of the shutter.

16. The shutter according to claim 15, wherein the enlarged heads,are in the form of caps removably attachable to the opposite ends of the flexible links.

17. The shutter according to claim 15, wherein the enlarged heads are integrally formed at the opposite ends of the flexible links.

* * * * *